US005530626A

United States Patent [19]

Norment

[11] Patent Number: 5,530,626

[45] **Date of Patent: *Jun. 25, 1996**

[54] ATHLETIC SHOE AND ARTICLES OF CLOTHING WITH REPLACEABLE UNITARY ASSEMBLY FOR GENERATING AND BROADCASTING AN AUDIBLE SIGNAL

[75] Inventor: Vincent E. Norment, Chicago, Ill.

[73] Assignee: Leonard Bloom, Towson, Md.; a part interest

[ * ] Notice: The term of this patent shall not extend beyond the expiration date of Pat. No. 5,345,700.

[21] Appl. No.: 304,496

[22] Filed: Sep. 12, 1994

Related U.S. Application Data

[63] Continuation-in-part of Ser. No. 93,976, Jul. 19, 1993, Pat. No. 5,345,700, which is a continuation-in-part of Ser. No. 828,564, Jan. 31, 1992, abandoned.

[51] Int. Cl.[6] ..... H04B 1/03

[52] U.S. Cl. ..... 361/814; 361/748; 361/796; 36/136; 174/52.2

[58] Field of Search ..... 361/752, 796, 361/748, 814; 36/136, 139, 132, 137; 455/91, 899; 174/52.2, 52.1; 257/787

[56] References Cited

U.S. PATENT DOCUMENTS 5,319,522 6/1994 Mehta ..... 361/748
5,345,700 9/1994 Norment ..... 36/139

*Primary Examiner*—Leo P. Picard
*Assistant Examiner*—Y. Whang
*Attorney, Agent, or Firm*—Leonard Bloom

[57] ABSTRACT

An athletic shoe (or other article of clothing) has a pocket formed therein, and an interchangeable unitary assembly is slidably received within the pocket and is retained therein by means of a flap carried by the shoe. The interchangeable unitary assembly preferably comprises a molded plastic card having a battery, microchip, speaker and on/off switch encapsulated therein and electrically connected together. A push (or "press") button is carried by the shoe and overlays the switch when the card is received in the pocket. The push button may be pushed to close the switch, so as to energize the microchip from the battery and generate an audible signal, such as a tune or message.

8 Claims, 8 Drawing Sheets

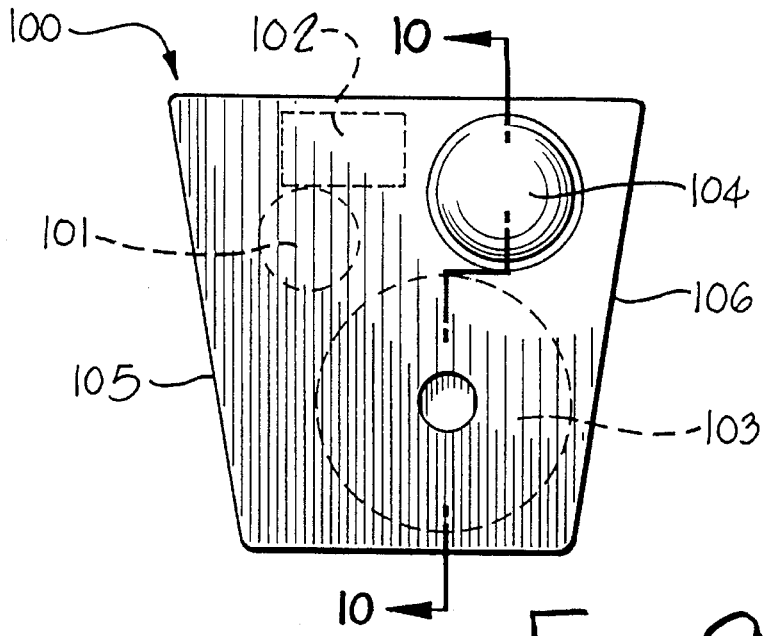
Fig. 9
Fig. 10
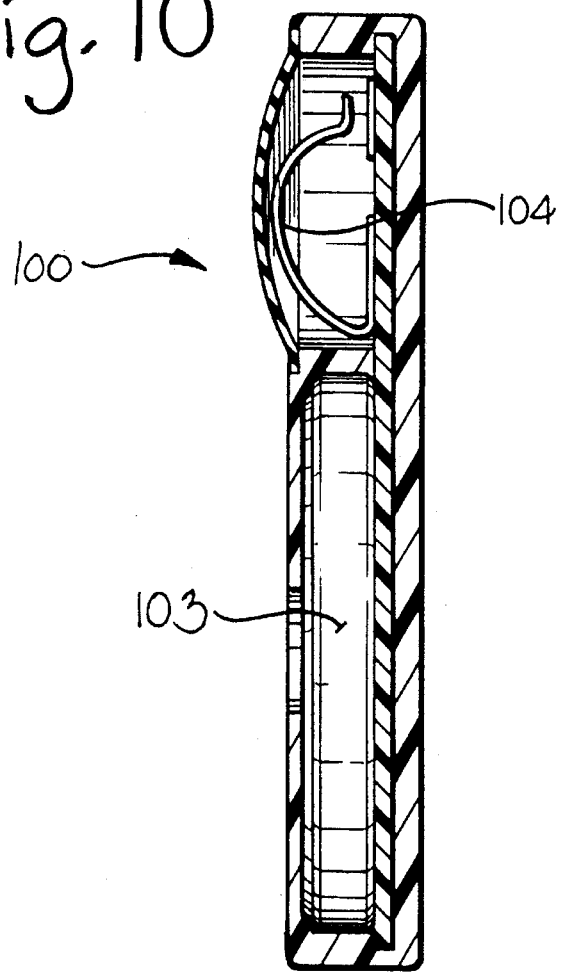

ATHLETIC SHOE AND ARTICLES OF CLOTHING WITH REPLACEABLE UNITARY ASSEMBLY FOR GENERATING AND BROADCASTING AN AUDIBLE SIGNAL

CROSS-REFERENCE TO RELATED APPLICATION

The present invention is a continuation-in-part of application Ser. No. 08/093,976 filed on Jul. 19, 1993 (and to be issued on Sep. 13, 1994 as U.S. Pat. No. 5,345,700) which, in turn, was a continuation-in-part of application Ser. No. 07/828,564 filed on Jan. 31, 1992 (now abandoned), the disclosures of which are incorporated herein in their entirety.

FIELD OF THE INVENTION

The present invention relates to athletic shoes and other articles of clothing that incorporate therein a unitary assembly for generating and broadcasting an audible signal, such as a musical composition, a message or the like.

BACKGROUND OF THE INVENTION

The desirability of providing footwear and other articles of clothing that incorporate therein assemblies that emit tunes, messages or other sounds has long been known.

For example, U.S. Pat. No. 4,646,350 issued to Batra discloses a shoe flap having an inner side on which a speaker, battery and microcircuit—discrete components—are separately mounted. This arrangement does not facilitate high-volume shoe manufacture. Moreover, the shoe is tied to a single message or tune; it is not interchangeable.

U.S. Pat. No. 4,825,471 issued to Jennings discloses a portable radio (or tape player) in the pocket of a shirt—actually a shirt harness—and connects the radio by wires to a pair of speakers, one on each sleeve. This is somewhat impractical and, besides, the portable radio must first be turned on and then inserted into its pocket; and there is no way to turn the radio on and off without removing the radio from the pocket.

U.S. Pat. No. 4,697,363 issued to Gamm merely discloses a pocket on a shoe for holding coins or keys while jogging.

It has also been known to incorporate various electrical circuitry with foot apparel to provide for the pick-up and broadcasting of noises, such as is disclosed in U.S. Pat. No. 4,660,305 issued to Medler, et al., and U.S. Pat. No. 5,001,852 issued to Schwartz. However, in both of these disclosures, the various components of the electrical circuitry are individual, and there is no suggestion therein to form such circuitry into a unitary assembly. Rather, in each case, the speakers for broadcasting the audible signal are remote from the shoe. Indeed, neither of these arrangements is capable of being formed into a unitary assembly.

Furthermore, like the disclosures noted above, in both Medler '305 and Schwartz '852, the noises to be broadcasted are noises made by mechanical elements (such as taps). It is noted that there is no suggestion in either of those disclosures of any arrangement that could electrically generate a noise. Thus, it is clear that the arrangements of these disclosures are not capable of generating either musical compositions or messages, nor do they lend themselves to being adapted for that purpose.

It has also been known to incorporate electronic circuitry with foot apparel for purposes other than to simply emit and/or amplify noises.

U.S. Pat. No. 3,702,999 issued to Grandisar; U.S. Pat. No. 3,791,375 issued to Pfeiffer; and U.S. Pat. No. 4,814,661 issued to Ratzlaff et al. each discloses arrangements that provide force (or weight) bearing sensing and warning systems. However, like the disclosures discussed above, none of the circuitry of these arrangements are unitary assemblies. Rather, in each of these disclosures, the circuitry includes speakers that are remote from the remainder of the subassembly.

U.S. Pat. No. 4,402,147 issued to Wu; U.S. Pat. No. 4,466,204 issued to Wu; U.S. Pat. No. 4,510,704 issued to Johnson; and 4,651,446 issued to Yukawa et al each disclose pedometers. However, none of these disclosures involves assemblies that are capable of either generating or broadcasting an audible signal. Thus, the arrangements of these disclosures are not capable of generating or broadcasting either musical compositions or messages, nor do they lend themselves to being adapted for that purpose. Furthermore, once again, the assemblies of these disclosures are not unitary. The only disclosures of which I am aware that incorporate devices or circuitry with foot apparel that emit musical compositions are U.S. Pat. No. 2,940,184 issued to Malone and U.S. Pat. No. 4,771,556 issued to Kim.

U.S. Pat. No. 2,940,184 issued to Malone discloses a mechanical arrangement that is built into the heel of a high heel shoe. This mechanical arrangement is comprised of several separate components and not a unitary assembly. Also, this arrangement is not capable of either electronically generating or broadcasting either a musical composition or a message. Furthermore, it is noted that the mechanical arrangement disclosed therein is quite complicated, involving a spring-driven music box mechanism. Unfortunately, the complexity of such a mechanical arrangement can be quite expensive and weighty, so as to affect the user's comfort. Also, such a complicated mechanical arrangement can only be incorporated into foot apparel that is of the variety that has an abnormally large heel, such as a high heel shoe. Such an arrangement would not be able to be satisfactorily incorporated into foot apparel not having such large heels, such as athletic footwear.

U.S. Pat. No. 4,771,556 issued to Kim discloses an arrangement wherein a circuit panel is mounted directly on the upper portion of the shoe for producing a speaker drive signal when activated. Separate from the circuit panel is a speaker, that is mounted in the heel of the shoe and which is responsive to the speaker drive signal that is generated by the circuit panel. The power supply is in the form of a photovoltaic cell that is also remote from the circuit panel and the speaker (although connected thereto). The power supply activates the circuit panel when the "VELCRO" type closure has been opened to expose the cell.

While being useful for its purpose, the Kim arrangement involves several separate components, each of which must be mounted separately. This arrangement does not present a unitary device. Use of such a device would necessitate substantial modification of the shoe, which is impractical. Also, the arrangement of Kim requires that the shoe be opened/closed for activation/deactivation of the power supply, so that the composition may be broadcast. No button whatsoever, or any other similar means that operates apart from the opening/closing of the shoe, has been disclosed for this purpose.

Other prior art of which I am aware are the following United States Letters Patents:

| Inventor | U.S. Pat. No. | Year of Issue |
|---|---|---|
| Schreck | 2,160,756 | 1939 |
| Casserd | 2,291,791 | 1942 |
| Miles | 2,735,220 | 1956 |
| Faranda | 2,811,811 | 1957 |
| Magiera | 3,340,846 | 1967 |
| Visitacion | 3,432,964 | 1969 |
| Schmidt | 3,501,144 | 1970 |
| Strelakos | 3,757,466 | 1973 |
| Liu | 4,043,241 | 1977 |

Accordingly, it can be seen that there remains a need for an arrangement wherein an athletic shoe (or other article of clothing) is combined with a unitary electronic assembly capable of both electrically generating and broadcasting an audible signal in the form of a musical composition, message or the like.

SUMMARY OF THE INVENTION

It is the primary object of the present invention to provide an arrangement, wherein a unitary electronic assembly capable of generating and broadcasting an audible signal in the form of a musical composition, message or the like is incorporated in combination with an athletic shoe or other article of clothing.

It is another object of the present invention to provide such a unitary electronic assembly which may be easily and simply removed from the shoe, so as to be replaceable with another assembly having the same or a different audible signal.

It is yet another object of the present invention to provide such a combination, wherein the assembly may be selectively and easily activated regardless of whether the shoe is either secured to, or unsecured from, the user's foot.

It is a further object of the present invention to provide such an assembly that may be incorporated in combination with athletic footwear (or other articles of clothing) especially to appeal to children of all ages.

It is a still further object of the present invention to provide such an arrangement that is simple, inexpensive and easy to use.

In accordance with the teachings of the present invention, there is herein illustrated and described an athletic shoe with a replaceable interchangeable unitary assembly for generating and broadcasting an audio signal. The athletic shoe has a pocket formed therein, the pocket having an opening, and a self-contained interchangeable unitary circuit board is inserted through the opening and into the pocket. The self-contained interchangeable unitary circuit board has a microchip, on/off switch, battery and speaker integrally mounted thereon, such that the self-contained interchangeable unitary circuit board may be readily removed and replaced. A flap is carried by the shoe and covers the opening in the pocket. The flap has a conspicuously-displayed button means thereon overlaying the switch on the self-contained interchangeable unitary circuit board, such that the button means may be pressed to close the on/off switch to generate and broadcast an audio signal, regardless of whether the shoe is being fastened or unfastened, and at the discretion of the wearer.

Preferably, the pocket has perforations formed therein, and the perforations are disposed below the flap and overlay the speaker on the unitary circuit board.

In a preferred embodiment, the shoe has a rearward counter portion, and the flap is mounted on the rearward counter portion of the shoe and extends forwardly therefrom transversely of the pocket and the direction in which the unitary circuit board is inserted into the pocket.

In accordance with the further teachings of the present invention, an article of apparel includes a pocket having a closure, and a self-contained interchangeable unitary circuit board (including a battery, speaker, microchip and on/off switch thereon) is received within the pocket and provides an audible sound. The pocket has a switch indicator conspicuously displayed thereon and overlaying the on/off switch on the self-contained interchangeable circuit board, such that the switch indicator may be pressed to depress the pocket to close the on/off switch thereby delivering the audible sound, and such that the closure may be opened to conveniently remove the self-contained interchangeable unitary circuit board from the pocket for replacement purposes.

In one embodiment, the article of apparel comprises footwear (such as an athletic shoe).

Preferably, a plurality or "library" of self-contained interchangeable unitary circuit boards are provided, so that the tunes may be easily and conveniently changed by the wearer.

In a further embodiment of the present invention, the interchangeable unitary circuit board comprises a molded plastic card and has the battery, speaker, microchip and associated circuitry encapsulated therein.

Preferably, the card has respective longitudinal side edges which are tapered and converge towards each other in the direction in which the card is inserted into the pocket means in the article of clothing, thereby facilitating the repeated insertion of the card into the pocket means and its removal therefrom.

These and other objects of the present invention will become readily apparent from a reading of the following description when taken in conjunction with the appended drawings.

BRIEF DESCRIPTION OF THE DRAWINGS

FIG. 4 corresponds substantially to FIG. 3 but shows how the push button may be depressed to generate the inspirational message, song, or the like.

FIG. 9 is a top plan view of a "second generation" interchangeable unitary circuit board encapsulated in a suitable plastic material for improved handling and reliability.

FIG. 10 is a cross-sectional view thereof, taken along the lines 10—10 of FIG. 9, and drawn to an enlarged scale.

DESCRIPTION OF PREFERRED EMBODIMENTS

Figure 1:
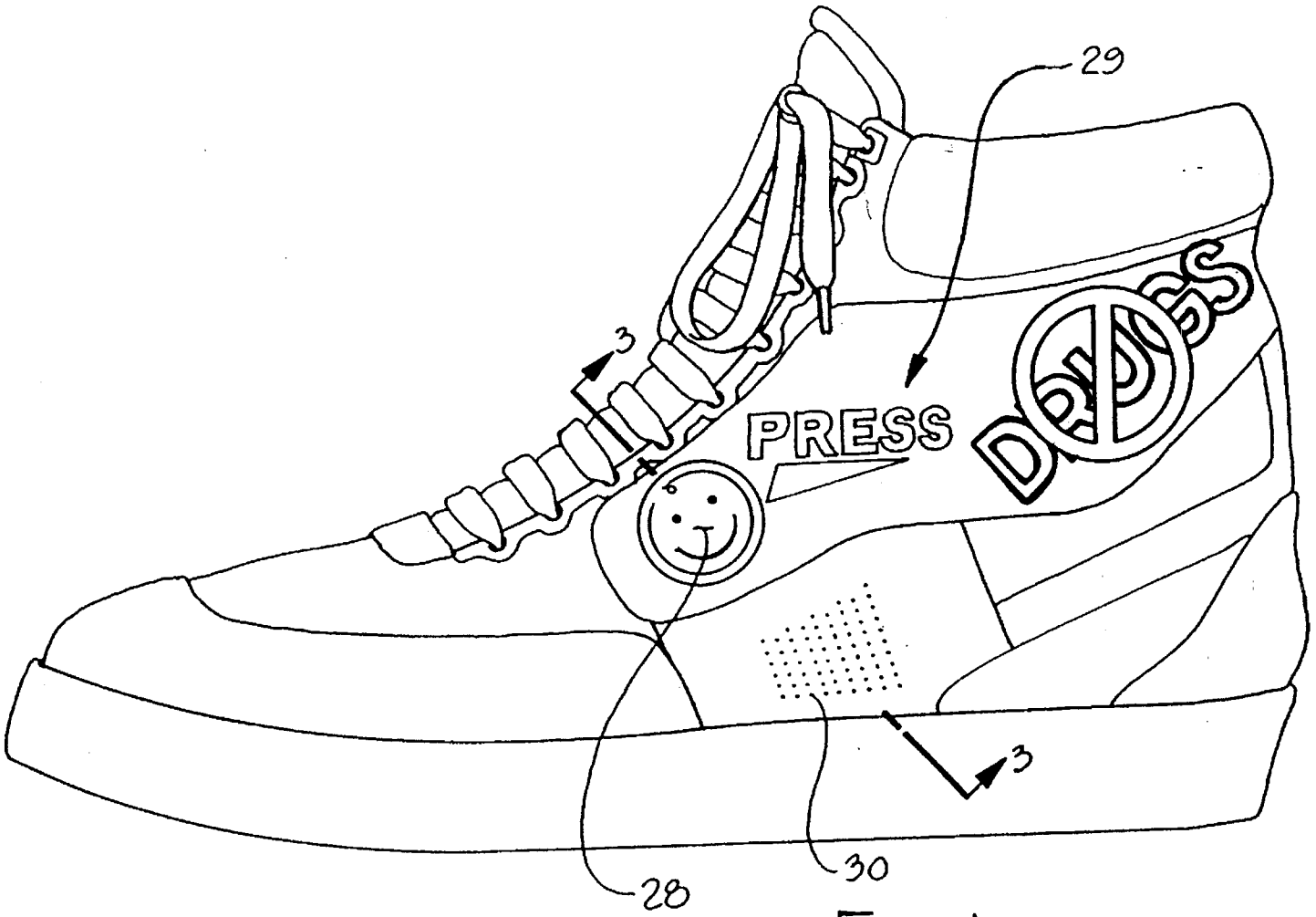
FIG. 1 is a side elevation of an athletic shoe, such as a basketball shoe, having a push button selectively activated to generate an audible signal, such as an inspirational message.
Figure 2:
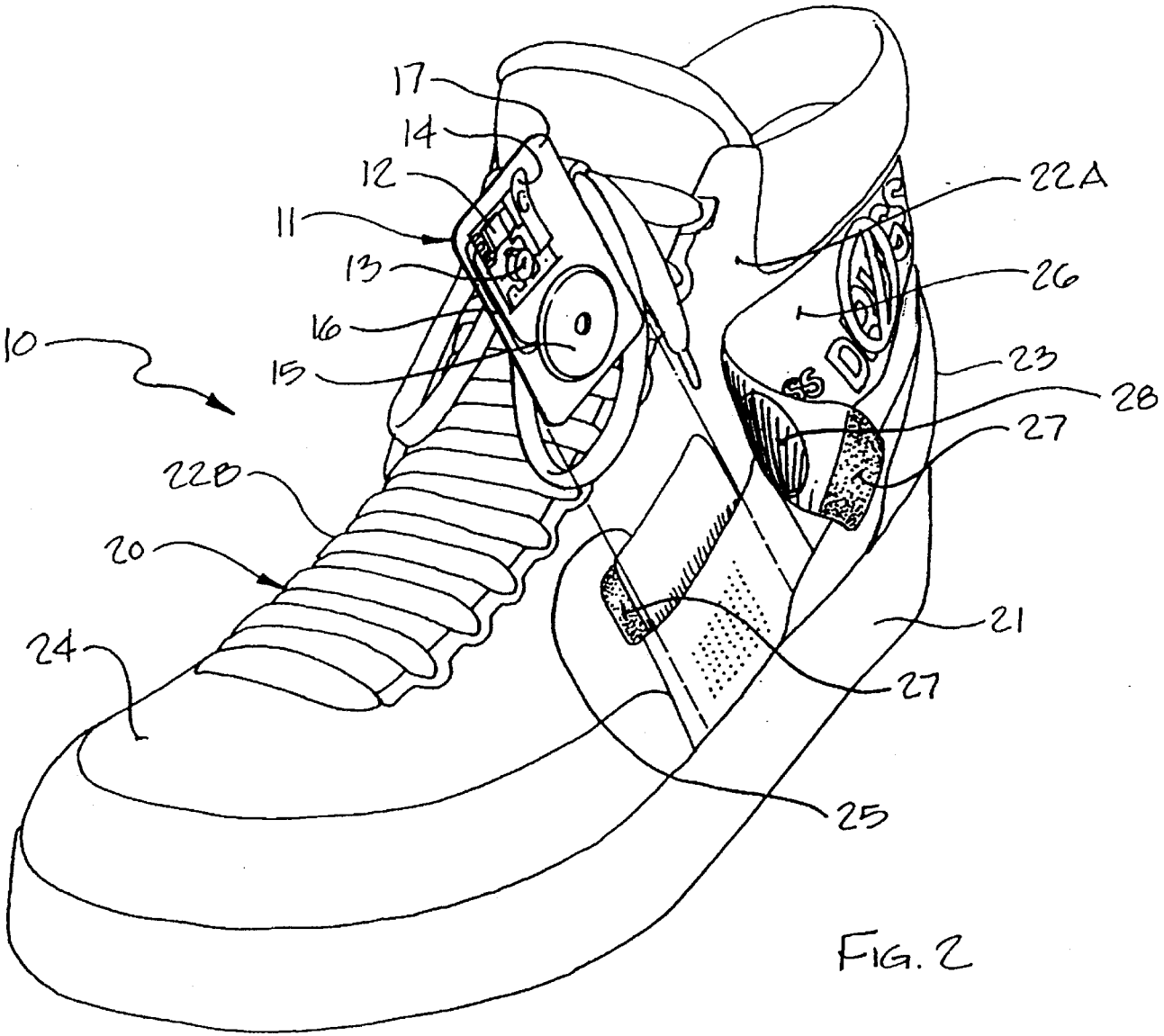
FIG. 2 is a perspective view of the athletic shoe of FIG. 1, but showing a flap lifted away from the shoe to enable a unitary assembly to be slidably removed from a pocket formed on the inner side portion of the shoe.
Figure 3:
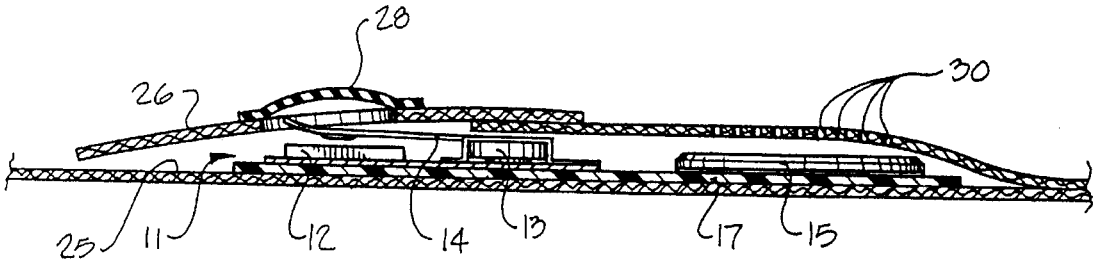
FIG. 3 is a section view taken across the lines 3—3 of FIG. 1 and showing the push button overlaying an on/off switch on the unitary assembly.
Figure 4:
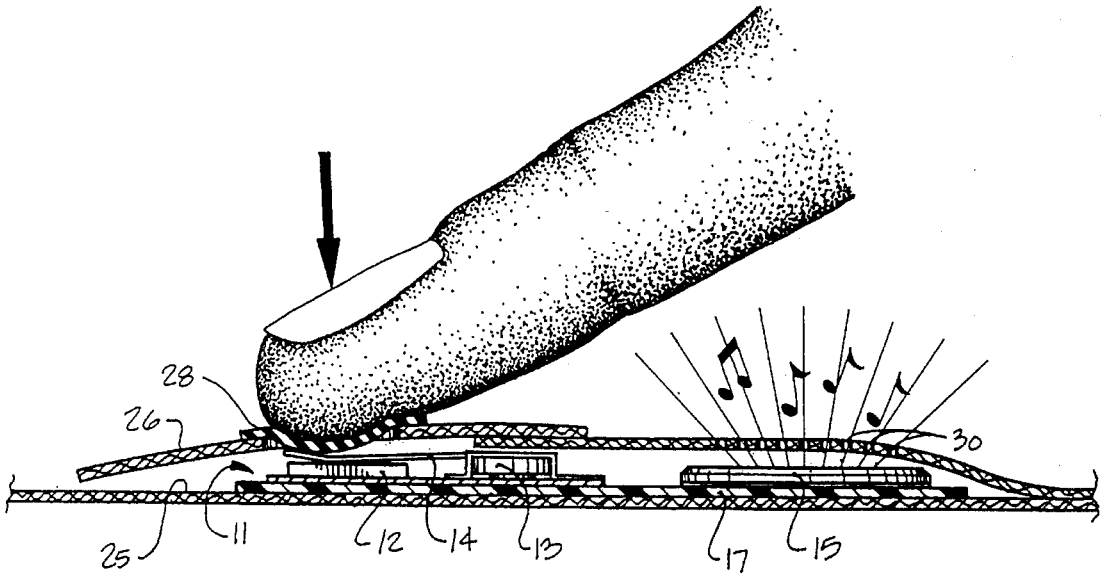
Figure 5:
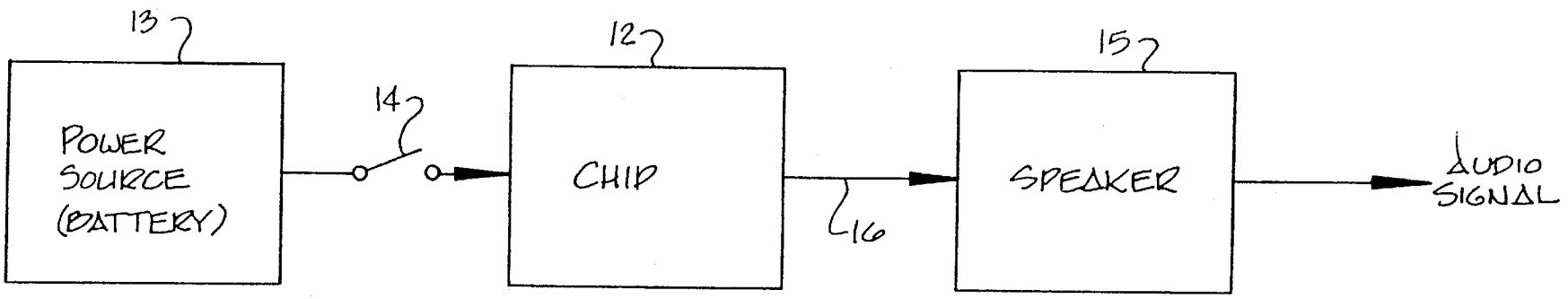
FIG. 5 is a block diagram showing, substantially, the electrical connections between the components of the unitary assembly, including a battery, microchip and speaker.

Referring to FIGS. 1–5 of the drawings, the combination 10 of the present invention comprises a unitary electronic assembly 11 (for generating and broadcasting an audible signal) and an athletic shoe 20 which carries the assembly 11.

The unitary electronic assembly 11 includes a microchip 12, a battery 13, a spring-loaded normally "open" on/off switch 14, a speaker 15, a means 16 for electrically connecting the microchip 12, battery 13, switch 14 and speaker 15 together, and a substantially flat, planar assembly board 17.

The microchip 12, carried by the assembly board 17, contains an audible signal, in the form of a musical composition, a message or the like, which is generated when energized. The microchip 12 may be any conventional microchip, which is well known to those skilled in the art, and which is useful for this purpose.

The battery 13 is also carried by the assembly board 17. This battery 13 is provided for energizing the microchip 12, so that the audible signal is generated thereby. Preferably, this battery 13 is a standard flat electrical battery, but any suitable battery 13 or power source may be utilized, especially those which are compact.

The on/off switch 14, which is also carried by the assembly board 17, is normally open. The switch 14 is associated with the battery 13 and the microchip 12 to selectively control the energizing of the microchip 12. When the switch 14 is closed, the microchip 12 may be energized by the battery 13. In this fashion, the generation of the audible signal may be selectively controlled.

The speaker (or speaker means) 15 is also carried by the assembly board 17. This speaker 15 receives the signal generated by the microchip 12 and then converts it to a broadcasted audible signal.

The microchip 12, battery 13, switch 14 and speaker 15 are electrically connected together by any suitable means, such as electrical wires 16 (or an equivalent printed circuit). This means 16 is also carried by the assembly board 17, so that a unitary electrical assembly is provided.

The combination 10 of the present invention includes the conventional athletic shoe 20 having a sole 21. Attached to the sole 21 are respective sides, including an inner side 22*a* and an outer side 22*b*, as well as a back (or heel) side 23. A portion of the sides 22*a* and 22*b* extend across the shoe, above the sole 21, so as to form a shoe top 24.

A pocket means 25 is formed on one of the sides (preferably the inner side 22*a*) of the shoe 20. Preferably, this pocket 25 is formed so that the open end thereof (the end through which the assembly 11 is disposed into the pocket 25) is oriented upwardly, so that when the assembly 11 is disposed therein, it will not fall out by reason of gravity.

The shoe 20 further includes a flap 26 that is carried by the shoe 20 and which may be disposed overlying at least a portion of the pocket means 25. Respective hook-and-loop fasteners 27 are carried by the shoe 20 and the flap 26, respectively. In this manner, the flap 26 may be lifted up to enable the unitary assembly 11 to be selectively removed from the pocket means 25. Further in this manner, the flap 26 may be lowered to enable the unitary assembly 11 to be selectively retained in the pocket means 25.

With respect to the above, the flap 29 and the fasteners 27 define means for selectively closing the pocket 25, and removably retaining the unitary assembly 11 within the pocket means 25. Such a means is useful for permitting the assembly 11 to be selectively removed from the pocket 25, as desired. This permits the assemblies 11 to be repaired (such as, for example, to replace a dead battery), or to be replaced with a different unitary assembly bearing a different audible signal.

Finally, the combination of the present invention includes a push button 28 that is associated with the on/off switch 14 for being pushed to close the switch 14, so as to energize the microchip 12. This push button 28 may be carried by either the shoe 20 or by the switch 14 itself. When carried by the shoe 20, it is contemplated herein that the button 28 will be carried by either the pocket 25 or by the flap 26, overlying the switch 14.

The push button 28 is easy to operate, thereby facilitating the use of the combination 10, especially among children or younger individuals to whom the messages are directed. One such message is one imploring children not to use drugs.

When the button 28 (or its equivalent) is pushed or otherwise activated, the switch 14 is closed and the message is generated; and when the user's finger is taken off of the push button 28, the switch 14 returns to its normal closed position and the message is eventually discontinued. In a preferred embodiment, one need only press the button once and, thereafter, the entire message (or song) is played, even though the user's finger is removed from the button. It is not necessary to maintain continuous pressure on the push button 28.

It is further preferred, as is seen in the drawings, for the push button 28 to include a visual means 29. This visual means 29 is provided mainly for visually indicating the location of the push button 28. This visual means 29 is also useful for encouraging potential users of the combination 10 to activate (that is, close) the switch 14 and to listen to the broadcasted message, musical composition and the like.

The visual means 29 employed may be any means well known to those skilled in the art for such purpose. An example of such a visual means 29 may include a visual design or graphics. Another example is printed words, such as "PRESS" or any other expression or admonishment. It is especially preferred that this visual means 29 includes both such visual designs, as well as printed words.

The audible signal generated by the speaker 15 passes through perforations 30 in the pocket 25 of the shoe 20.

Figure 6:
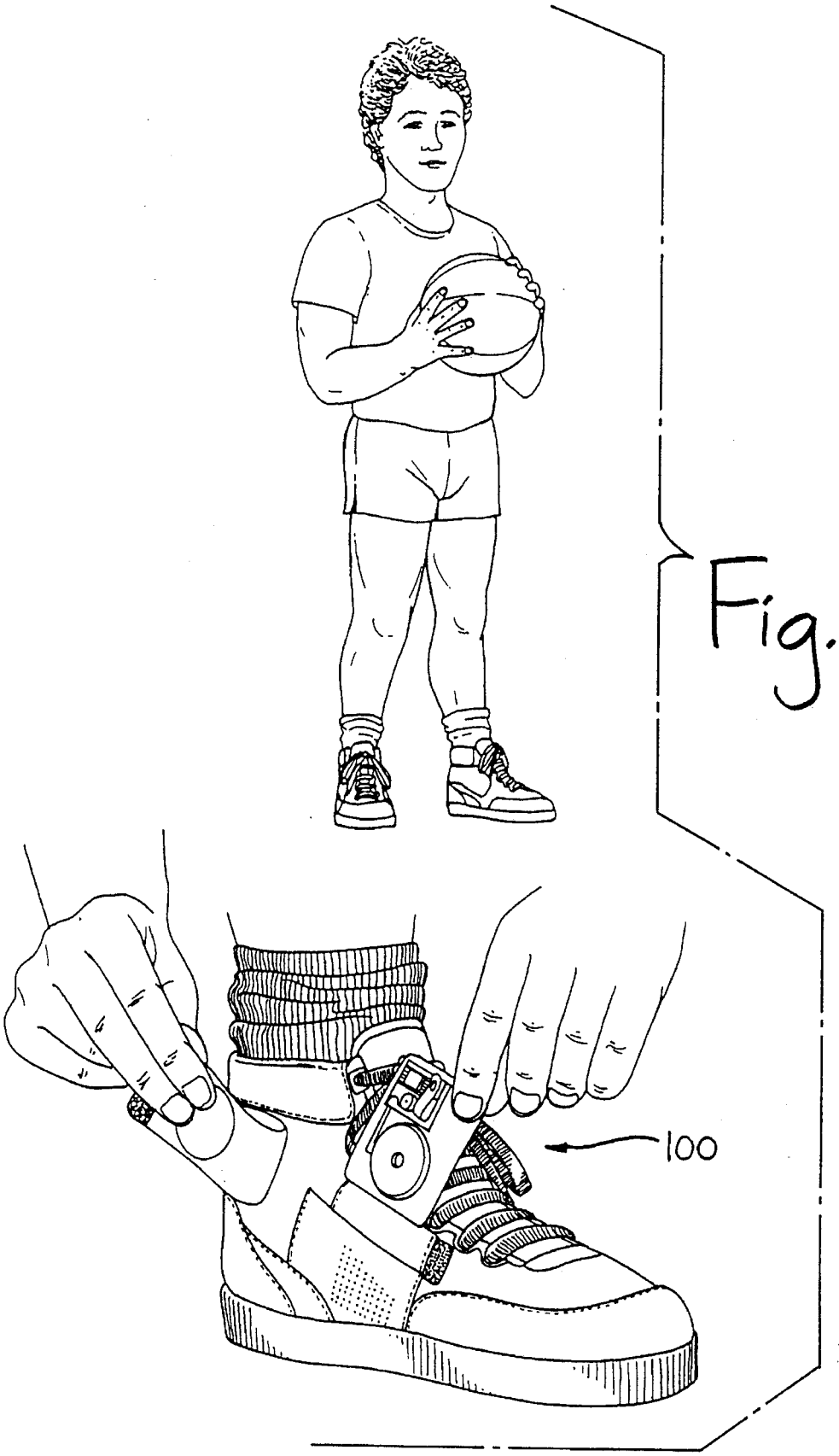
FIG. 6 is a pictorial view, showing the invention applied to an athletic shoe.
Figure 7:
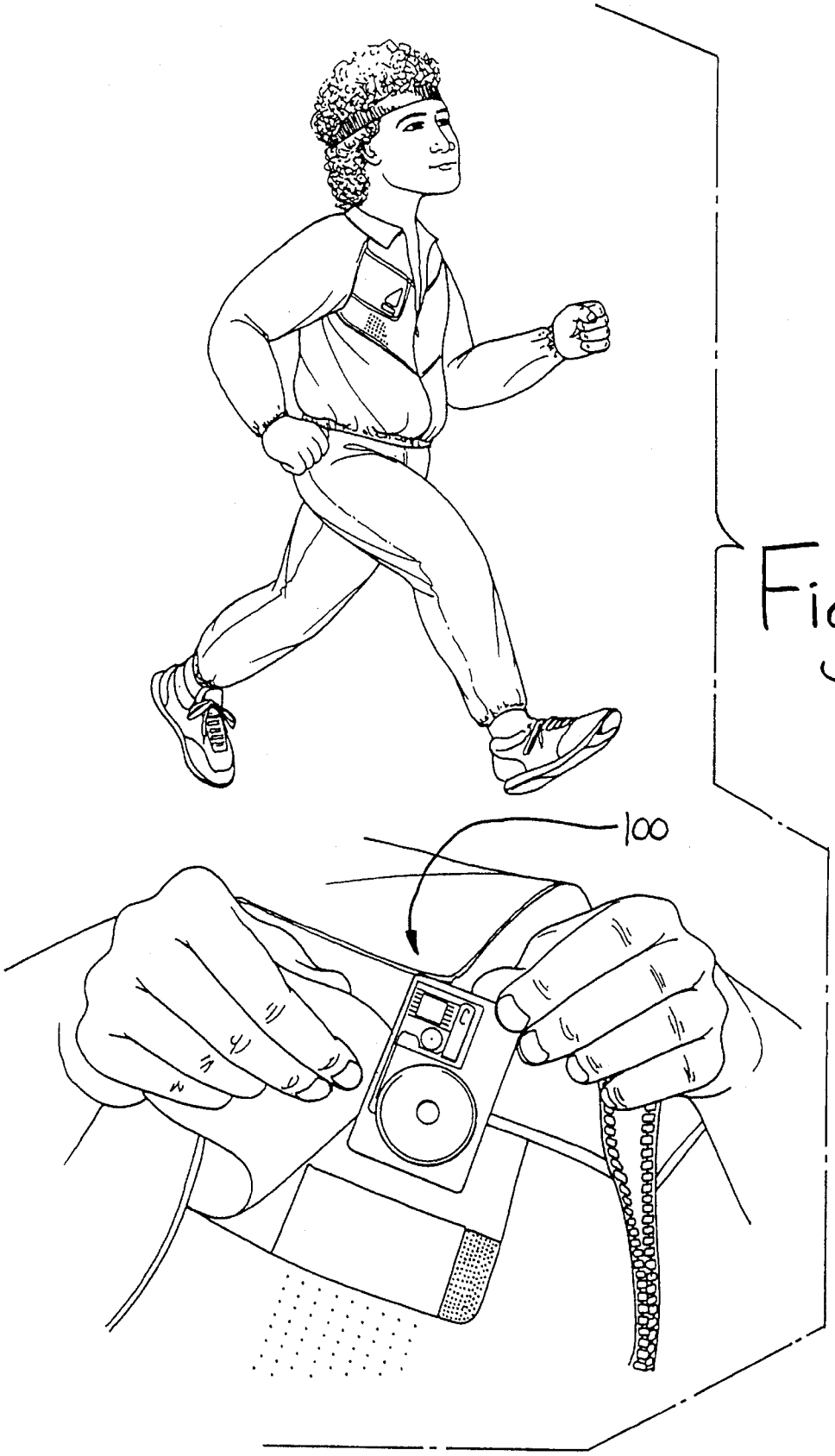
FIG. 7 is a pictorial view, showing the invention applied to a jacket.
Figure 8:
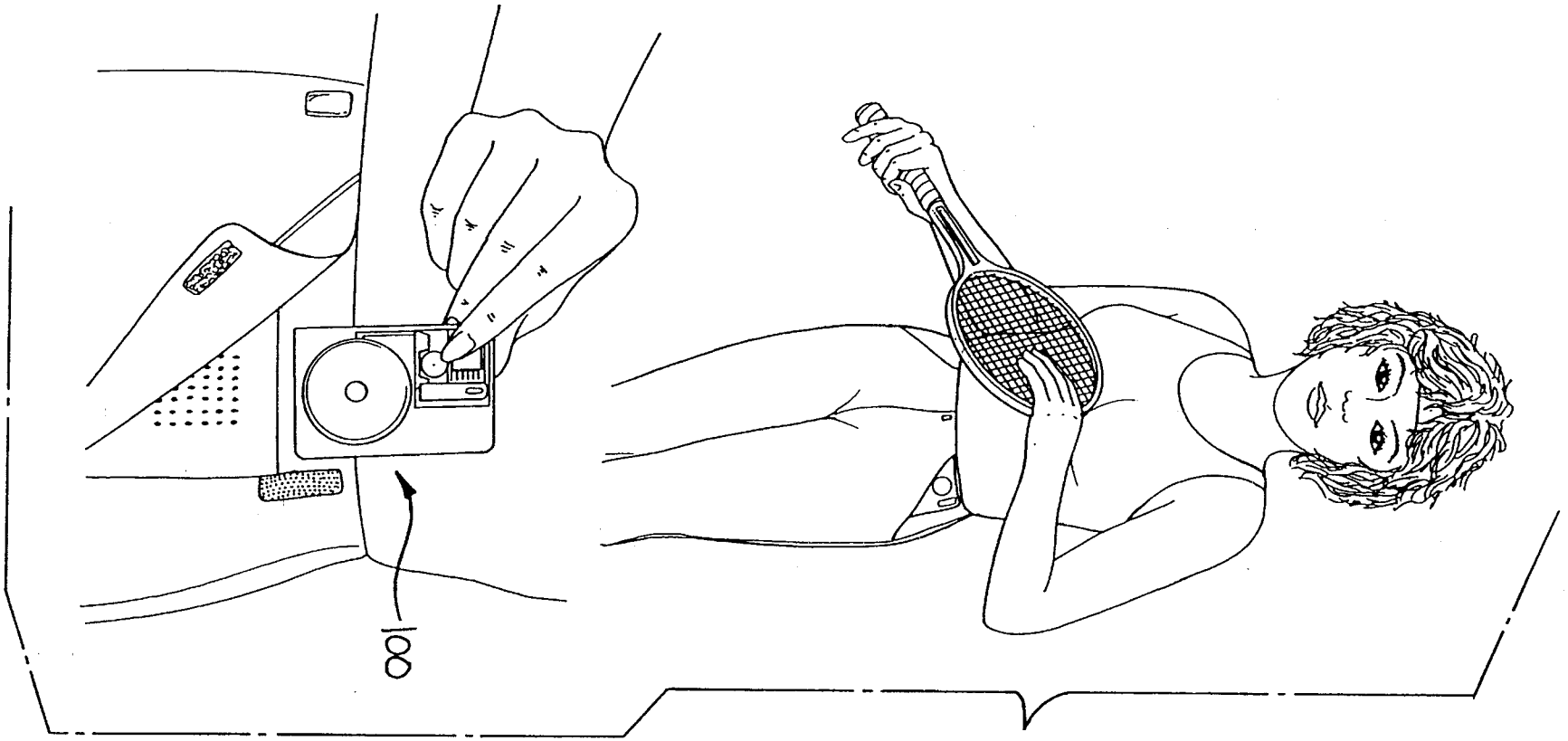
FIG. 8 is a pictorial view, showing the invention applied to a pair of jeans.

The invention is applicable to a wide variety of footwear and clothing. For example, and with reference to FIGS. 6, 7 and 8, the present invention is applicable to an athletic shoe, jacket and jeans, respectively.

With reference to FIGS. 9 and 10, the unitary interchangeable board comprises an encapsulated "card" 100 in which the major components (including the battery 101, "chip" 102, speaker 103 and switch 104) are retained in a suitable molded plastic material. This improves the reliability and ruggedness of the card 100 and facilitates its repeated insertion into the pocket (in the footwear or article of clothing) and its removal therefrom.

Moreover, and as shown more clearly in FIG. 9, the card 100 has respective longitudinal side edges 105 and 106 which are tapered or converge towards each other in the direction in which the card 100 is inserted into the pocket. This facilitates the insertion of the card 100 into the pocket.

If desired, the battery 101 could be removable (not shown).

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. The combination of an interchangeable unitary circuit board and an article of clothing, wherein the article of clothing includes a pocket means for receiving the interchangeable unitary circuit board, wherein the interchangeable unitary circuit board is actuated externally of the article of clothing to broadcast an audible sound, and wherein the interchangeable unitary circuit board is encapsulated and comprises a molded plastic card.

2. The combination of claim 1, wherein the interchangeable unitary circuit board includes a battery, speaker and circuitry encapsulated therein.

3. The combination of claim 2, wherein the circuitry in the interchangeable unitary circuit board comprises a microchip.

4. The combination of claim 2, wherein the article of clothing further has a "press" button prominently displayed thereon, the "press" button overlaying the speaker on the card and in registry therewith.

5. The combination of claim 1, wherein the article of clothing has a flap covering the pocket means therein, and wherein means are provided for removably attaching the flap to the article of clothing.

6. An interchangeable unitary circuit board for use with an article of clothing, wherein the article of clothing includes a pocket means for receiving the interchangeable unitary circuit board, and wherein the interchangeable unitary circuit board may be actuated externally of the article of clothing to broadcast an audible sound, the improvement wherein the interchangeable unitary circuit board is encapsulate and comprises a molded plastic card, wherein the interchangeable unitary circuit board has respective longitudinal side edges which are tapered and converge towards each other in the direction in which the card is inserted into the pocket means in the article of clothing.

7. An interchangeable unitary circuit board for use with an article of clothing, wherein the article of clothing includes a pocket means for receiving the interchangeable unitary circuit board, wherein the interchangeable unitary circuit board includes a battery, speaker and microchip and associated circuitry, and wherein the interchangeable unitary circuit board is actuated externally of the article of clothing to broadcast an audible sound, the improvement wherein the interchangeable unitary circuit board is encapsulated and comprises a molded plastic card, the card having respective longitudinal side edges which are tapered and converge towards each other in the direction in which the card is inserted into the pocket means in the article of clothing, and the article of clothing having a flap covering the pocket means therein, means for removably attaching the flap to the article of clothing, and the article of clothing further having a "press" button prominently displayed thereon, the "press" button overlaying the speaker on the card and in registry therewith.

8. The improvement of claim 7, wherein the article of clothing comprises footwear.

* * * * *